US006758682B1

(12) United States Patent
Kosmala

(10) Patent No.: US 6,758,682 B1
(45) Date of Patent: Jul. 6, 2004

(54) POGO CONTACT

(75) Inventor: Michael Lawrence Kosmala, Mission Viejo, CA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 10/367,189

(22) Filed: Feb. 13, 2003

(51) Int. Cl.[7] ..... H01R 12/00
(52) U.S. Cl. ..... 439/66; 439/824; 439/700
(58) Field of Search ..... 439/66, 83, 700, 439/824

(56) References Cited

U.S. PATENT DOCUMENTS 2,724,096 A * 11/1955 Klostermann ..... 439/824
4,904,213 A * 2/1990 Hock et al. ..... 439/824
5,174,763 A * 12/1992 Wilson ..... 439/66
5,727,954 A * 3/1998 Kato et al. ..... 439/66
5,993,269 A * 11/1999 Ito ..... 439/824
6,416,331 B1 * 7/2002 Shimizu ..... 439/66
6,464,511 B1 * 10/2002 Watanabe et al. ..... 439/66
6,503,089 B2 * 1/2003 Saijo et al. ..... 439/70
6,579,104 B1 * 6/2003 Bishop et al. ..... 439/66

* cited by examiner

*Primary Examiner*—Tho D. Ta
(74) *Attorney, Agent, or Firm*—Roger C. Turner

(57) ABSTRACT

A connector has a frame (12) with passages (22) that hold contact assemblies (20), the contact assemblies having lower ends (114) soldered to traces (52) on a circuit board (54) and depressable upper ends, which provides low resistance within each contact assembly and which assures reliable soldering to traces on the circuit board. Each contact assembly includes a metal sleeve (60), a pogo tip (30) with a body (64) vertically slidable in the sleeve and a post (66) projecting above the sleeve, and a helical spring (72) that urges the pogo tip upwardly. The spring has an upper end (92) shaped to engage only one side of the bottom of the pogo tip body to cock the pogo tip for low resistance engagement with the sleeve. The spring is of much lower conductivity than the sleeve, to minimize current flow through the spring and unwanted inductance. The frame includes an elastomeric plate (84) that lies in an interference fit with each contact. The lower end (114) of each contact initially lies below standoffs (120), but slides upwardly when the connector is pressed down against a circuit board for soldering.

13 Claims, 3 Drawing Sheets

POGO CONTACT

BACKGROUND OF THE INVENTION

One type of connector includes a frame with multiple passages and multiple contact assemblies lying in the passages. Each contact assembly has a lower end that is soldered to a trace on a circuit board. Each contact assembly has a contact tip that is biased upwardly by a spring, but which can be deflected downward considerably when engaging another device. Electrical contact between the contact device and the lower end of the sleeve can be established through engagement of the contact tip with the inside of the sleeve, or through the spring. Electrical connection though engagement of the contact tip with the sleeve has previously not been reliable. Electrical connection through the spring can result in unwanted inductance due to the multiple turns of the spring. A contact that provided good electrical connection between the contact tip and the bottom of the sleeve without substantial inductance, would be of value.

Soldering of the contact assembly lower ends to traces on the circuit board, can be accomplished by close control of the distance that the contact lower ends project below the frame lower surface, provided that the circuit board is not warped. However, if the circuit board is warped, then some solder connections may not be made. A system that assured that all contacts made soldered connections with traces on the circuit board, despite slight warping of the circuit board and/or connector frame would be value.

SUMMARY OF THE INVENTION

In accordance with one embodiment of the present invention, a connector is provided, of the type that has contact assemblies with contact tips, or pogo tips, that can be considerably depressed and lower ends for soldering to circuit boards, which assures good electrical connections between the top and bottom of each contact, and which enables reliable soldering of the connector lower ends to traces on a circuit board despite warping of the circuit board (and possibly the connector). Each connector assembly includes a sleeve, a pogo tip with a body slideable within an upper portion of the sleeve and with a post that extends above the sleeve, and a largely helical spring that biases the pogo tip upwardly while allowing it to be depressed a considerable distance.

The upper end of the spring is constructed to engage only one side of the lower end of the pogo tip, to cock the pogo tip, especially when it is depressed. This results in low resistance engagement between the body of the pogo tip and the inside walls of the sleeve, to thereby assure good electrical connection between the pogo tip and the sleeve. The spring is formed of material having a much higher resistivity than the resistivity of the sleeve material, to minimize the amount of current passing through the spring, and thereby minimize unwanted inductance.

The connector frame includes a quantity of elastomeric material with portions forming an interference fit with the sleeves of the contact assemblies. The contact assemblies are initially installed in the passages by pressing them down until the contact lower ends project below standoffs at the lower end of the frame. To solder the contact lower ends to traces on a circuit board, the connector frame is pressed down towards the circuit board, thereby causing the contact assemblies to shift upwardly despite interference fit with the elastomeric material. This assures that the bottom of each contact engages a corresponding trace on the circuit board, despite warpage of the circuit board (or possible warpage of the connector frame).

The novel features of the invention are set forth with particularity in the appended claims. The invention will be best understood from the following description when read in conjunction with the accompanying drawings.

DESCRIPTION OF THE PREFERRED EMBODIMENTS

Figure 1:
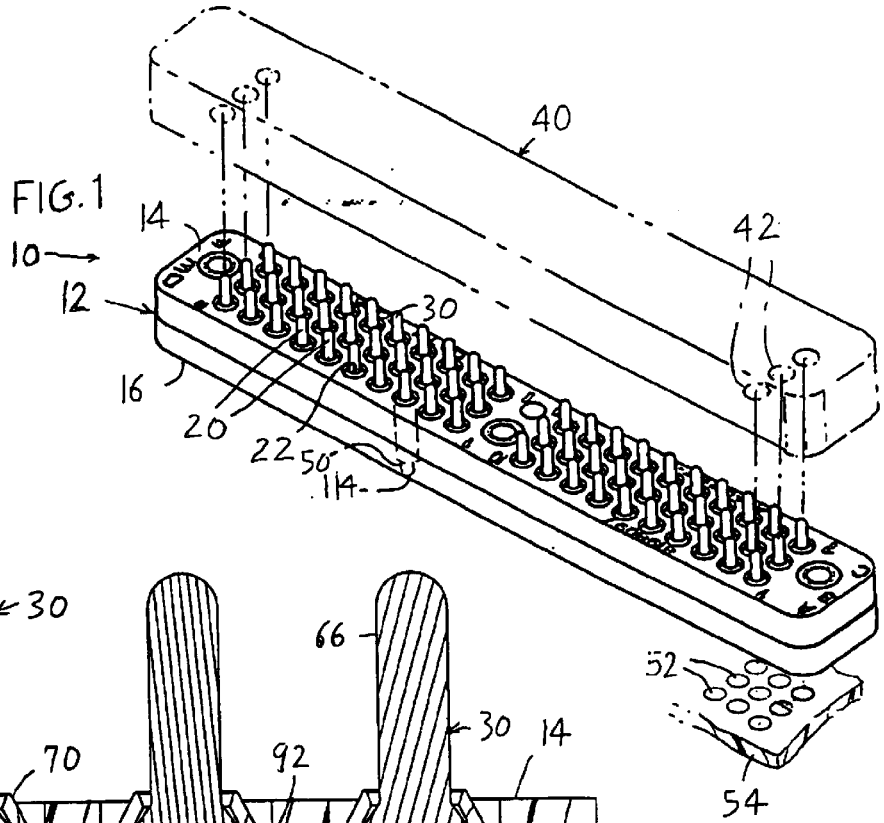
FIG. 1 is an exploded view of a connector of the present invention, of a portion of a circuit board that the connector can be soldered to, and a mating connector (shown in phantom lines).

FIG. 1 illustrates a connector 10 of the present invention, which has a frame 12 with upper and lower surfaces 14, 16 and with a plurality of contacts, or contact assemblies 20 lying in passages 22 of the frame. Each contact assembly 20 is of a type that has a contact tip, or pogo tip 30 that can be depressed a considerable distance. The particular contact assemblies allow the pogo tips to be depressed until their upper ends are about flush with the frame upper surface 14. A mating device 40 has multiple contact pads 42, and when the mating device is pressed down towards the connector 10, good electrical connection is made between the contact assemblies 20 of the connector and the contact pads 42 of the mating device 40. Each contact assembly has a lower portion 50 with a bottom 114 that is designed to be surface soldered to a trace or pad 52 on a circuit board 54. This allows the connection of circuitry on the circuit board, through the connector 10, to the mating device 40 and to circuitry connected thereto.

Figure 2:
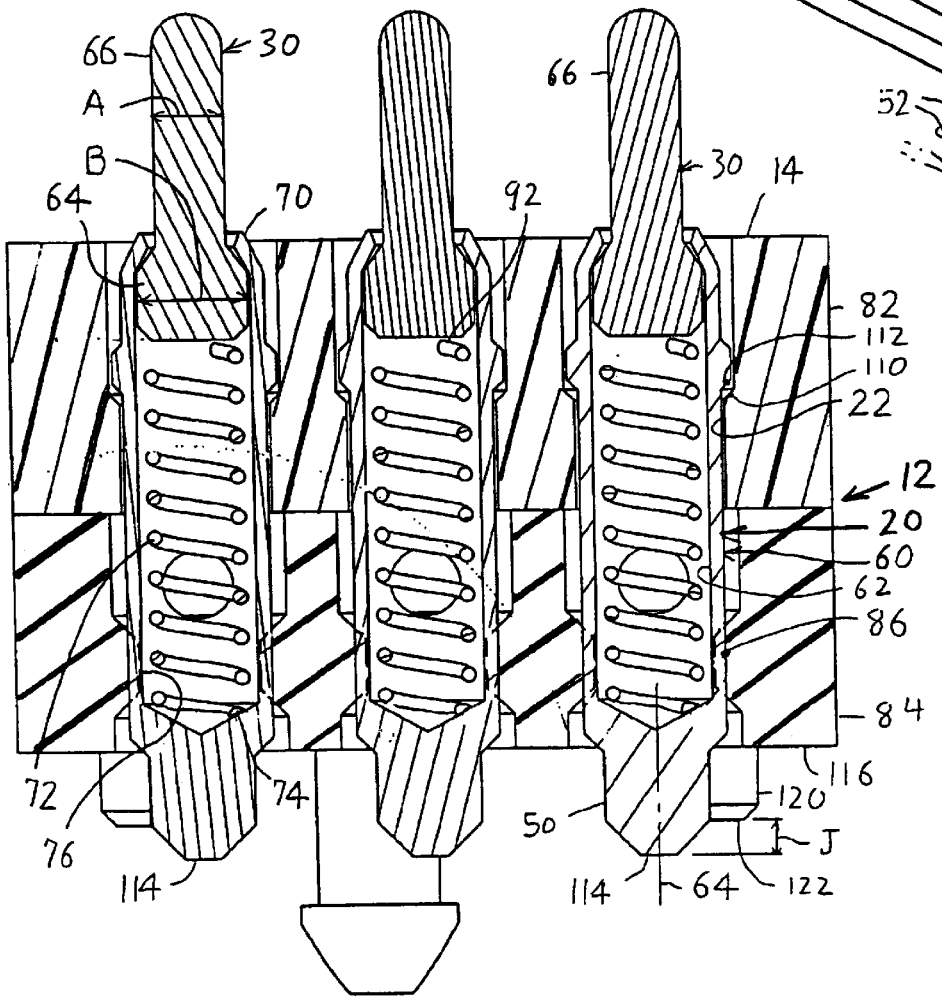
FIG. 2 is a sectional view of the connector of FIG. 1, with the contact assemblies in their initial positions.

FIG. 2 shows details of the frame 12 and contact assemblies 14 of the connector 10. Each contact assembly includes a sleeve 60 that has an inner sleeve surface 62 having a vertical axis 64. Each pogo tip 30 includes a lower portion or body 64 that lies within the sleeve, and an upper projection in the form of a post 66 that project through an upper end 70 of the sleeve and above the upper surface 14 of the frame. The post 66 has a smaller diameter A than the diameter B of the pogo tip body. The upper end 70 of the sleeve is swaged to a smaller diameter than the body, to retain the pogo tip in the sleeve A largely helical spring 72 biases the pogo tip upwardly. The spring has a lower end 74 that presses against the bottom of a blind bore 76 in the sleeve that forms the sleeve inner surface. The upper end 92 of the spring presses the pogo tip upwardly. The contact frame includes upper and lower plates 82, 84. The upper plate 84 is constructed of rigid polymer material, or engineering plastic (Young's modulus over 100,000 psi). The lower plate 84 is constructed of elastomeric material such as rubber (Young's modulus of no more than 50,000 psi) and has passage walls at 86 that lie in interference fit with the sleeve 60, as will be described later herein.

Figure 4:
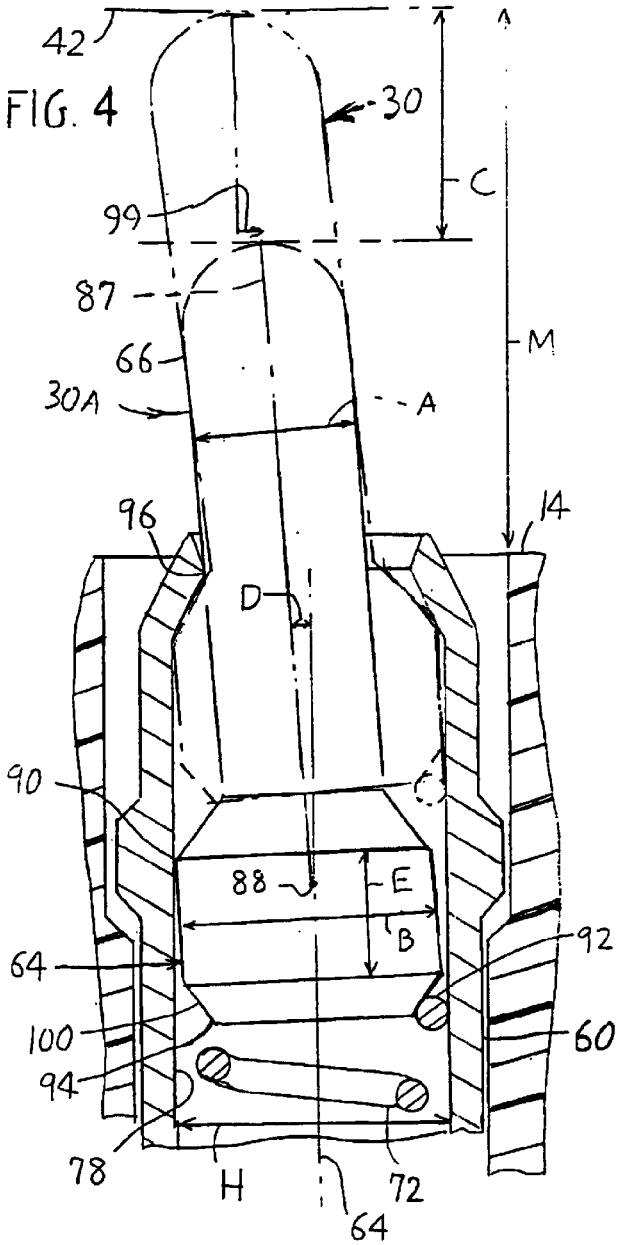
FIG. 4 is a sectional view of a portion of the connector of FIG. 2, showing the upper portion of one of the contact assemblies, with the contact assembly shown in its initial position in phantom lines, and shown in its deflected position in solid lines.

FIG. 4 shows the pogo tip at 30A depressed by a distance C that is almost half of the initial post projection height M that the post 66 projects above the upper surface 14 of the frame. It is noted that in the initial, undeflected position 30 of the pogo tip, the axis 87 of the pogo tip is cocked and angled close to the final angle D, and usually somewhat more. When the pogo tip has been depressed as to 30A, it is cocked, and its axis is tilted at 87. At 87 the pogo tip extends at an angle D of at least one degree, and preferably a plurality of degrees about an axis 88 perpendicular to axis 87, from the axis 64 of the sleeve 60.

Such cocking of the pogo tip 30 is desirable, because it establishes low resistance contact of the pogo tip with the sleeve, as at contact point 90. Such cocking and consequent low resistance engagement of the pogo tip with the sleeve, is largely due to the spring upper end 92 pressing against only one side of the bottom 94 of the pogo tip body 64. Such upward force applied to only one side of the body 64, causes tilt of the body. Such tilt results in engagement of the pogo tip at 90 and 96 with the sleeve. Such contact at at least one of the points 90, 96, results in reliable low resistance engagement of the pogo tip with the sleeve. Such cocking also results in a wiping action along distance 99 against the pads 42.

It is possible to carry current between the pogo tip 30 and the sleeve 60 substantially only or primarily through the spring 72. In that case, instead of forming the spring of a stainless steel material which forms a reliable spring, but has a conductivity less than 10% of highly conductive alloys, applicant would form the spring of a higher cost highly conductive material. Applicant then would form the upper end of the spring to engage the lower end of the pogo tip along most of a 360° circle, to avoid cocking of the tip. However, when high frequency signals are transferred through the contact assembly, the substantial inductance resulting from much (at least half) of the current passing through the multiple turns of the helical spring, results in degradation of the signal. Unless the forward tip is cocked, it makes only intermittent engagement with the sleeve. Accordingly, applicant forms the spring of low conductivity material (e.g. stainless steel) and forms the sleeve of high conductivity material (e.g. a phosphor bronze with several times higher conductivity than stainless steel).

Figure 3:
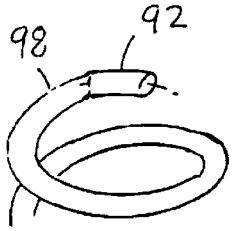
FIG. 3 is a partial isometric view of the upper portion of one of the springs of the connector of FIG. 2.

Applicant forms the spring upper end as shown at 92 in FIG. 3, so it extends by much less than a full turn, and so a portion 98 of the spring just below the upper end 92 is angled downwardly by many degrees to extend at a steep downward incline, to avoid pressing against the pogo tip. By assuring engagement of only the limited length spring upper end 92, applicant assures that spring forces are applied to only one side of the pogo tip to cock it and assure engagement of the pogo tip with the sleeve at the locations 90, 96. To further enhance tilting or cocking of the pogo tip, applicant forms a lower portion of the body with a beveled or chamfered surface at 100, the chamfer extending around the entire axis of the pogo tip so there is no need for rotational alignment of the pogo tip with the spring during installation. In addition, the body 64 lies loosely within the sleeve, and has only a small axial length E. The length E of maximum diameter of the body, is preferably no greater than the maximum diameter B of the body. Also, the body maximum diameter B is preferably between 90% and 97% of the inside diameter H of the sleeve, to allow substantial tilting, but not allow the spring 92 to pass the beveled portion 100.

To assemble the connector, applicant presses all of the contact assemblies 20 (FIG. 1) downwardly into the passages 22 of the frame 12, until the contact assemblies are prevented from moving down any further. FIG. 2 shows that the frame upper plate 82 forms largely upwardly-facing shoulders 110 while each sleeve has a largely downwardly-facing shoulder 112. When all contact assemblies are pushed downwardly into the frame, the shoulders 110, 112 engage or substantially engage, and these are the initial positions of the contact assemblies in the frame. In the initial positions, lower ends 114 of the contact assemblies project a considerable distance below the frame lower surface 116. The frame is formed with standoffs 120 that project below the frame lower surface 116, and the contact assembly lower ends 114 extend a substantial distance J below the standoff in the contact initial positions. The bottom 122 of the standoffs can be referred to as lowermost board-engaging surfaces of the frame bottom surface.

Figure 5:
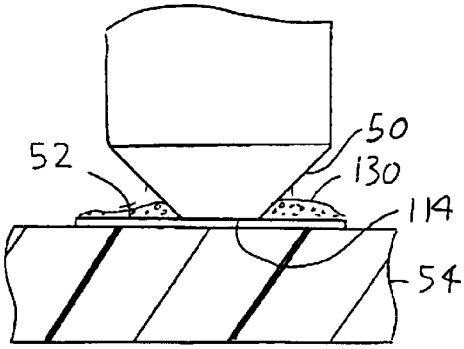
FIG. 5 is a partial sectional view of the connector assembly of FIG. 1, showing the bottom of a contact assembly ready for soldering to a trace on the circuit board.
Figure 6:
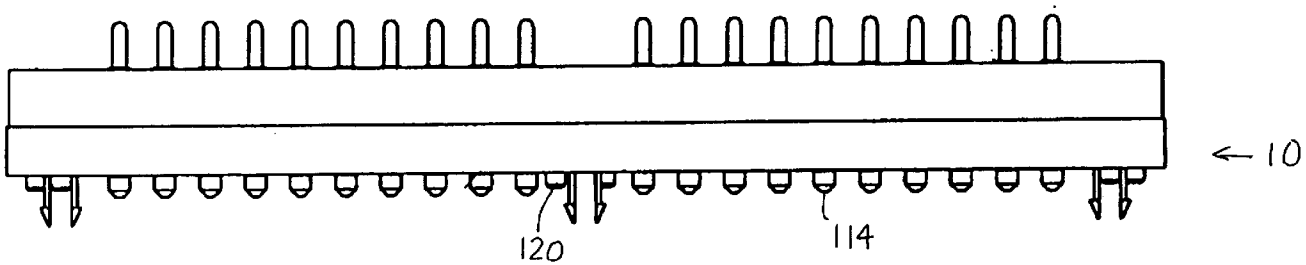
FIG. 6 is a side elevation view of the connector of FIG. 1.

FIG. 5 shows a contact lower end 114 directly engaging a trace 52 on the circuit board 54. A small amount of soldering material 130, which includes balls of solder in paste, has been placed on each trace 52. With the contact bottom 114 pressed into the soldering material 130, heating of the soldering material will melt it, including the tiny balls of solder within the paste, and cause soldering of the contact lower portion 50 to the circuit board trace 52. Usually, the traces 52 are close together and only a small amount of soldering material 130 is placed on each trace. As a result, the bottom 114 of each contact must lie very close to the trace 52 in order to assure a good solder joint.

Figure 7:
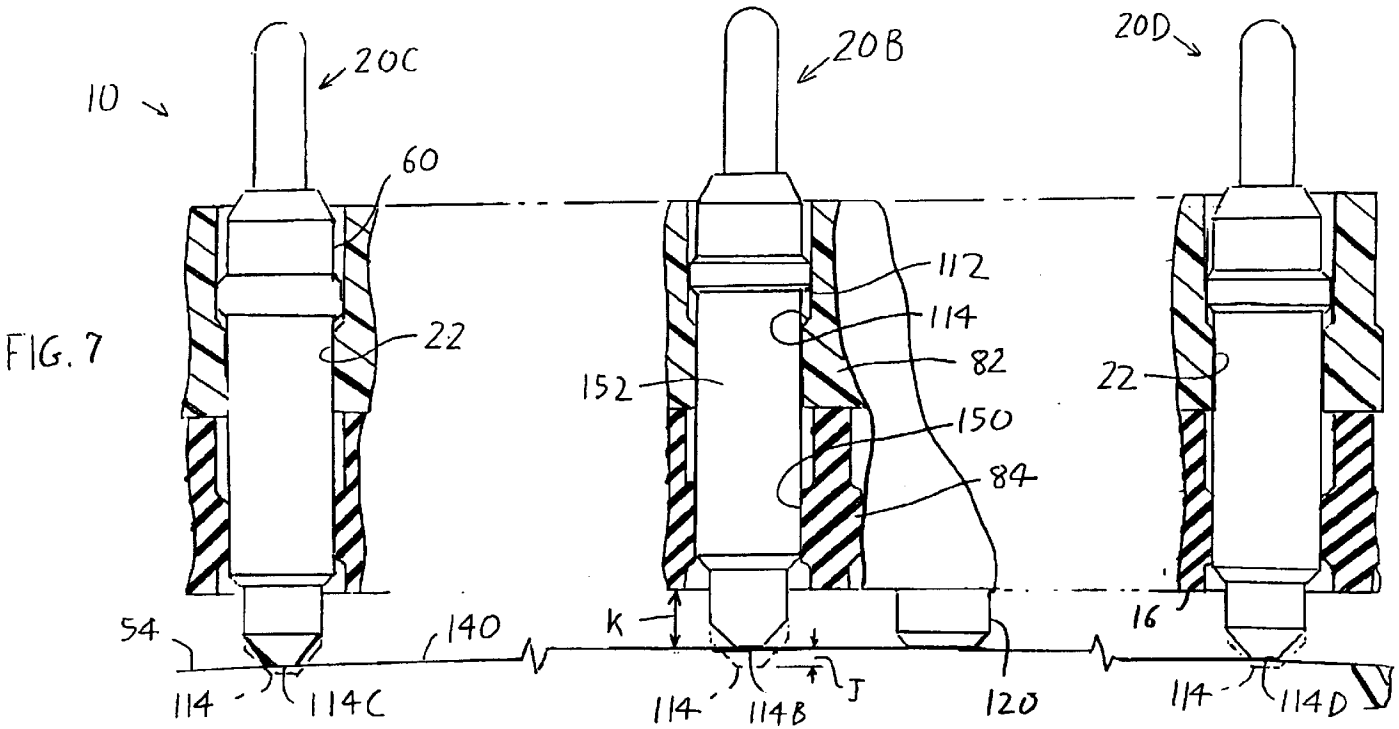
FIG. 7 is a partial sectional view of the connector of FIG. 1, after it has been pressed down against a circuit board that is warped.

FIG. 7 shows a situation where the circuit board is warped with its upper face 140 being convexly warped. When the connector 10 is pressed downward toward the circuit board upper face 140, the sleeve 60 of each contact assembly 20 slides upwardly along a passage 22. If the circuit board upper face 40 were precisely planar, then all sleeves would slide upwardly by distance J until they extended a distance K below the frame lower surface 16. Such sliding distance J is shown for contact assembly 20B, where the contact lower surface at 114B is flush with the bottom of the standoff 120. However, since the circuit board upper surface is warped, the different contact assemblies such as 20C and 20D must move by different amounts to all remain substantially engaged with a corresponding location of the circuit board. That is, the lower surfaces 114 of the contact assemblies move up by less than J, only to the positions 114C and 114D to remain engaged with pads on the warped circuit board. Thus, by having all contacts slidable upwardly in the corresponding frame passages 22, applicant is able to assure that the lower ends of all contact assemblies will contact or lie very close to the corresponding circuit board traces to assure good solder joints.

Applicant constructs the lower plate 84 of the frame, of elastomeric material, and with passage walls 150 that lie in an interference fit with the outer surface 152 of each contact sleeve. As a result of such interference fit, the contact assemblies tend to remain in their initial positions, so they do not fall out during handling of the connector. However, the contact assemblies are readily pushed up within the passages of the frame, when the frame is firmly pushed down against the circuit board.

In a connector of the construction illustrated that applicant has constructed and successfully tested, the connector 10 had an overall length of 42 mm, a width of about 4.5 mm, and a frame thickness of about 3.5 mm. Each of the contacts had a pogo tip post of a diameter A (FIG. 4) of 0.5 mm, a sleeve inside diameter H of about 0.70 mm, a body outside diameter B of 0.67 mm, and a body height E of 0.32 mm along its maximum diameter. The contacts were spaced along each row and each column spaced at a pitch of about 1.7 mm. Each contact tip was depressable by a force of about one-half ounce, and each contact was upwardly slideable within the elastomeric wall portions by about the same force. The contact lower ends 114 initially lay a distance J of 0.25 mm below the standoffs.

While terms such "top", "lower", etc. have been used to describe the invention as it is illustrated, it should be noted that the connector can be used in any orientation with respect to the Earth.

Thus, the invention provides a connector of the type that has contact tips, or pogo tips that can be depressed, which assures good electrical connection between opposite ends of each contact assembly while avoiding inductances that would result from a majority of the current passing through the springs of a contact assembly. Also, the connector is constructed to facilitate reliable connection of the lower ends of the contact assemblies to traces on a circuit board even if the board is warped. Good electrical connection between the pogo tip and sleeve of a contact assembly is provided by purposely cocking the pogo tip. This can be accomplished by constructing the upper end of the helical spring so it presses upward against only one side of the body of the pogo tip to cock it. Reliable soldering of lower ends of the contact assemblies, despite a slightly warped circuit board, is assured by constructing the connector so the contacts can be forced to slide up along the passages. This can be accomplished by forming a portion of the frame of elastomeric material, and forming the elastomeric material so it forms an interference fit with the sleeve of each contact assembly. When the connector is pressed down against a circuit board, the contact assemblies slide upward to a new position, with the amount of sliding of each contact assembly automatically controlled to equal the amount necessary to assure that the bottom of the contact assembly engages or lies very close to the corresponding circuit board trace.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A connector that includes a frame with upper and lower surfaces and a plurality of passages therein and a contact assembly lying in each passage, wherein each contact assembly includes an electrically conductive sleeve that has a sleeve top and sleeve bottom and that has an inner sleeve surface with an axis, a contact tip with a contact tip body lying in said sleeve and a contact tip upper portion projecting above said frame upper surface and above said sleeve top, and a spring lying in said sleeve and biasing said contact tip upwardly while allowing the contact tip to be depressed downwardly, wherein:

said spring has an upper end that engages said contact tip body on only one side of said axis, whereby to cock the contact tip.

2. The connector described in claim 1 wherein:

said spring is substantially helical, but with a spring top that engages only one side of said spring and a portion below said top that extends at a steep enough downward incline to avoid engaging the body.

3. The connector described in claim 1 wherein:

said spring is formed of spring wire bent into a primarily helical shape;

said contact tip has a lower portion that is beveled to extend at a downward incline toward said axis and be engaged by said spring upper end.

4. The connector described in claim 1 wherein:

said sleeve is formed of a sleeve material having a high conductivity, and said spring is formed of material having less than half the conductivity of said sleeve material, whereby most current flowing between said contact tip and said sleeve bottom tends to flow through said sleeve rather than through said spring.

5. The connector described in claim 1 wherein:

said body of said contact tip has a body diameter of over 90% of the sleeve inside diameter along a height that is substantially parallel to said axis, but said body lies loosely in said sleeve and said height is no more than said diameter, whereby to permit tilting of said contact tip by a plurality of degrees.

6. The connector described in claim 1 wherein:

said sleeve has a lower end that projects below said frame bottom surface;

said frame includes an elastomeric portion and said sleeve lies in an interference fit with said elastomeric portion to resist axial sleeve movement while allowing such movement when an upward force is applied to the sleeve.

7. A method for surface soldering lower ends of multiple contacts of a connector to traces on a surface of a circuit board, where the connector includes a frame with top and bottom surfaces, the bottom surfaces having lower bond-engaging surfaces, and a plurality of passages, said contacts each lying in one of said passages, comprising:

constructing said frame with interference passage wall portions that lie in interference fit with said contacts;

initially inserting each of said contacts so its lower end projects below said lowermost surfaces;

pressing said lowermost surfaces against said face of said circuit board, while the traces on the circuit board press against the contact lower ends and cause sliding of the contacts upward along said interference passage wall portions, and then soldering said contact lower ends to said traces.

8. The method described in claim 7 wherein:

said step of constructing said frame includes constructing it with a portion of rigid material forming parts of said passages with largely upwardly-facing passages;

constructing said contacts with largely downwardly-facing shoulders;

said step of initially inserting said contacts includes pressing them downwardly into said passages until said shoulders of a plurality of contacts and of a plurality of said passage, abut each other and said contacts lie in interference fit with said interference passage wall portions.

9. The method described in claim 7 wherein:

each of said contacts includes a sleeve and a pogo tip with a body that is slideable in the sleeve and a post that project at least as high as the sleeve; and biasing each of said pogo tips upwardly by pressing upward against only one side of said body to cock the pogo tip.

10. A connector for mounting on a circuit board, wherein the connector includes a frame with top and bottom surfaces and with passage walls forming a plurality of passages extending between said surfaces, and a plurality of contacts each lying in one of said passages, wherein:

said frame includes a plurality of standoffs each projecting downward from said frame bottom surface by a predetermined standoff distance;

each contact includes a lower end that is solderable to a circuit board trace and that, in an initial position, extends downward below said standoffs;

said passage walls including a portion that grips each of said contacts to resist upward sliding of the contact along the passage while permitting such sliding when the contact is forced upward by engagement with a circuit board trace as the connector frame is pushed down toward the circuit board;

said frame including elastomeric material forming part of the walls of said passages, with walls of said elastomeric material lying in interference fits with said contacts.

11. The connector described in claim 10 wherein:

said frame includes first and second plates each forming a portion of each of said passages, said first plate being constructed of rigid material and forming a largely upwardly-facing shoulder, and each of said contacts forms a largely downwardly-facing shoulder, to limit downward movements of said contacts to said initial positions;

said second plate is formed of elastomeric material with passage walls forming said parts that lie in interference fits with said contacts.

12. A connector having a sleeve with upper and lower ends, a pogo tip with a body lying in said sleeve and a post projecting above said sleeve upper end, and a spring lying in said sleeve and pressing upwardly against said pogo tip and urging cocking of said pogo tip body, wherein said sleeve has a vertical axis;

said body has a body portion of maximum diameter (B) in a direction perpendicular to said axis and said body portion has a height (E) parallel to said axis along the body portion of maximum diameter, said height being less than said diameter, whereby to enable greater tilt of said pogo tip said spring has an upper end that presses against one side of said body to urge said body to tilt.

13. A connector for mounting on a circuit board, wherein the connector includes a frame with top and bottommost frame surfaces and with passage walls forming a plurality of vertical passages, and a plurality of contacts each lying in one of said passages, wherein:

each contact includes a lower contact portion that has a lower end that is solderable to a circuit board trace and that, in an initial position, extends downward below said bottommost surface; and means for gripping said contact portion of each of said contacts to resist sliding of the contact along the passage while permitting such sliding when the contact is forced upward to an upward position, by engagement of a lower end of the contact with a circuit board trace as the connector frame is pushed down toward the circuit board, said means for gripping frictionally gripping said contact portion to resist both upward and downward sliding movement of said contact portion after it reaches said upward position.

* * * * *